United States Patent [19]

Gohnert

[11] 4,171,332

[45] Oct. 16, 1979

[54] FUEL-AIR MIXER FOR CARBURETORS

[76] Inventor: Walther Gohnert, P.O. Box 62, Black Diamond, Wash. 98010

[21] Appl. No.: 858,552

[22] Filed: Dec. 8, 1977

[51] Int. Cl.[2] ..... F02M 29/04

[52] U.S. Cl. ..... 261/78 R; 48/180 M; 261/DIG. 39

[58] Field of Search ..... 261/DIG. 39, 78 R; 123/141; 48/180 M, 180 R

[56] References Cited

U.S. PATENT DOCUMENTS

| | | | |
|---|---|---|---|
| 504,260 | 8/1893 | Worth . | |
| 690,989 | 1/1902 | Olds . | |
| 755,093 | 3/1904 | Wright | 123/141 |
| 1,018,851 | 2/1912 | Thompson | 48/180 R |
| 1,076,309 | 10/1913 | Patterson . | |
| 1,118,237 | 11/1914 | Saint Cyr | 48/180 R |
| 1,121,868 | 12/1914 | Riotte et al. . | |
| 1,122,038 | 12/1914 | Smith . | |
| 1,160,662 | 11/1915 | Slaby . | |
| 1,261,230 | 4/1918 | Haynes . | |
| 1,473,349 | 11/1923 | Kach | 48/180 R |
| 1,473,508 | 11/1923 | O'Nan | 48/180 R |
| 1,729,382 | 9/1929 | Harel | 261/DIG. 39 |
| 1,734,723 | 11/1929 | Gildehaus, Jr. . | |
| 1,780,626 | 11/1930 | McIntosh . | |
| 1,801,446 | 4/1931 | Muhr | 123/141 |
| 1,809,375 | 6/1931 | Chase | 48/180 R |
| 1,816,412 | 7/1931 | Tipton | 48/180 R |
| 1,925,583 | 9/1933 | Delplanque . | |
| 1,967,577 | 7/1934 | Katz | 261/66 |
| 2,126,132 | 8/1938 | Paasche . | |
| 2,283,567 | 5/1942 | Nealey . | |
| 2,384,681 | 9/1945 | Janes . | |
| 2,843,368 | 7/1958 | Schmidt . | |
| 2,985,524 | 5/1961 | Jacobus . | |
| 2,996,290 | 8/1961 | Munden . | |
| 3,449,098 | 6/1969 | Larson . | |
| 3,664,648 | 5/1972 | Seeley, Jr. | 261/DIG. 39 |
| 3,685,808 | 8/1972 | Bodai | 261/DIG. 39 |
| 3,883,621 | 5/1975 | Hammerschmied . | |
| 3,954,092 | 5/1976 | Polaner . | |
| 4,044,741 | 8/1977 | Swingley | 261/DIG. 39 |
| 4,053,544 | 10/1977 | Moore | 261/DIG. 39 |

FOREIGN PATENT DOCUMENTS

| | | | |
|---|---|---|---|
| 507475 | 11/1954 | Canada | 48/180 R |
| 391083 | 10/1908 | France | 48/180 R |
| 2319775 | 1/1975 | France | 261/DIG. 39 |
| 2264982 | 10/1975 | France | 261/DIG. 39 |
| 982461 | 2/1965 | United Kingdom | 123/41 |

*Primary Examiner*—Tim R. Miles

*Attorney, Agent, or Firm*—Wells, St. John & Roberts

[57] ABSTRACT

A carburetor comprising atomizing wire screen means positioned within the fuel mixture supply tube and baffle means within the induction tube adjacent the boost venturi for causing an increased amount of air flow through said venturi.

16 Claims, 12 Drawing Figures

FUEL-AIR MIXER FOR CARBURETORS

BACKGROUND OF THE INVENTION

The present invention relates to the field of carburetors for internal combustion engines and more specifically to an improvement for an internal combustion engine carburetor that performs the function of more completely mixing fuel and air prior to its reception within the induction duct of the carburetor.

The primary problem with carburetors for internal combustion engines is that they are inadequate in breaking up the fuel droplets. This results in relatively large droplets of fuel which will not completely vaporize in the intake manifold resulting in droplets of raw fuel which will not completely burn in the engine combustion chambers. The result is low engine operating efficiency with formation of carbon monoxide and high hydrocarbon emissions. Both these conditions are very undesirable, especially in view of the ever-decreasing supply of fossil fuel. It therefore becomes desirable to produce a carburetor improvement that will break up the larger droplets of fuel and disperse them more evenly.

DESCRIPTION OF A PREFERRED EMBODIMENT

Figure 1:
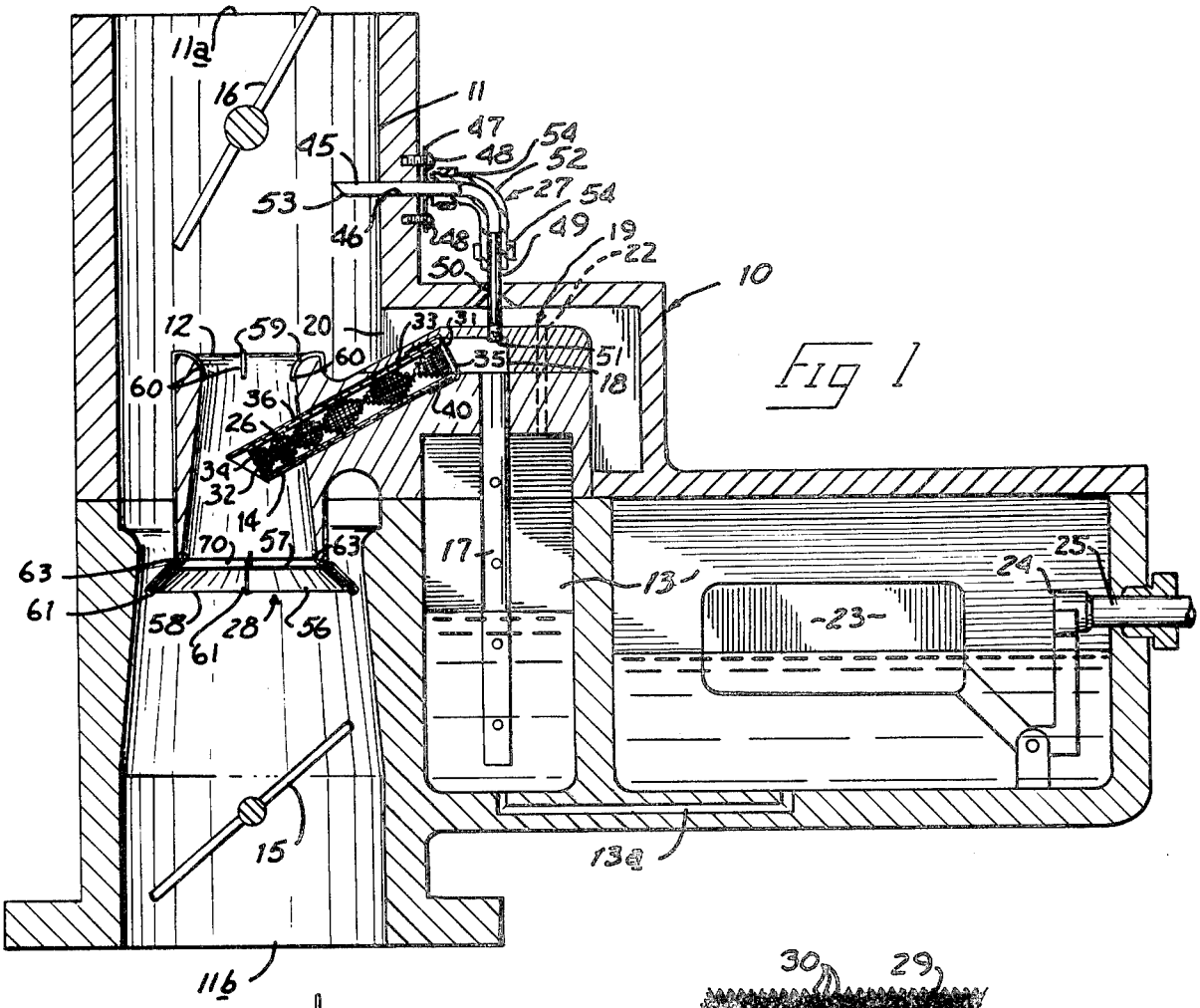
FIG. 1 is a sectional diagrammatic view of the carburetor.

FIG. 1 shows a carburetor in diagrammatic representation. The carburetor 10 is not intended to be shown with all the refinements present in contemporary carburetors. It is merely the intent to illustrate the carburetor in this form to show the relationship between the components of my invention and standard carburetor components.

The carburetor includes an elongated downdraft induction tube 11 through which air passes from an intake end 11*a* downwardly through the tube 11 to a discharge end 11*b*. Again, the tube is only diagrammatically represented, it being understood that it could be situated as a side draft or updraft form without changing the function or essential features of my invention.

A venturi 12 is located coaxially within the induction tube 11. Fuel is supplied from a fuel supply system including a reservoir 13 provided as an integral part of the carburetor. The fuel is delivered to the venturi 12 through a fuel supply tube 14 that connects the venturi and a chamber 18 in communication with fuel reservoir 13. The amount of fuel and air leaving through the discharge end of the induction tube is controlled by a butterfly throttle 15. The amount of intake air entering the induction tube is controlled by a butterfly choke plate 16.

The fuel within reservoir 13 is drawn through the tube 14 by vacuum pressure due to the volume and velocity of air passing by the open end of the supply tube 14 within the venturi. Therefore, a siphon tube 17 that interconnects the chamber 18 above the reservoir 13 with the tube 14 will respond to the vacuum pressure by drawing fuel upward through its length and into chamber 18. The fuel brought to the chamber 18 is free to exit downwardly through the fuel supply tube 14 and, subsequently, into the air moving rapidly through the venturi 12.

An air vent 19 is provided to enable functioning of the reservoir at atmospheric pressure. It opens at 20 to the air moving through the induction tube 11. An air bleed 22 connects the air vent 19 and the main reservoir body 13. The float section of the reservoir 13 is vented in the usual manner with a vent valve (not shown) near the fuel entry to reservoir 13.

The level of fuel within reservoir 13 is controlled by a float 23 operatively connected to a float valve 24. A fuel line 25 operates in conjunction with the float valve 24 to maintain a continuous level of fuel within the reservoir 13. As illustrated, the reservoir is broken into two main portions that are interconneted by a duct 13*a*. This isolates the fuel siphon tube 17 and maintains the elevation of the fuel substantially constant regardless of the angular disposition of the carburetor.

The carburetor elements, as briefly discussed above, are substantially typical to most forms of carburetors whether they be single venturi or multiple venturi types. It is contemplated that the present invention will be equally useful with multiple venturi carburetors as with single venturi forms, and useful with single or multiple barrel carburetors.

The present invention is comprised of an improvement for a carburetor whereby the fuel droplets are progressively reduced in size as the fuel progresses from the reservoir portion 18 to the discharge end of the fuel supply tube 14. These droplets of reduced size are presented to the turbulent air passing through the induction tube 11 to produce an even, homogeneous mixture of fuel and air for clean burning within the associated engine combustion chambers. The present improvements may be supplied in kit form to enable modification of existing carburetors, or may be supplied as an integral part of a new or rebuilt carburetor.

The improved combination is comprised of three basic elements including a screen 26, an air bleed means 27, and an air baffle means 28. It is the primary purpose of the screen 26 to progressively decrease the size of fuel droplets passing through the tube 14. The air bleed means 27 is utilized to adjust the amount of outside air entering into the chamber 18 so as to control the richness of the fuel mixture entering tube 14. The baffle means 28 is supplied for directing air through the central venturi 12 rather than allowing the air to pass around the venturi through the induction tube 11. This increases the velocity of air flow through the venturi and thereby produces a somewhat greater suction through the fuel supply tube 14 to compensate for the obstruction presented by screen 26.

Figure 2:
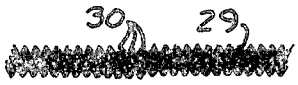
FIG. 2 is a view of the present screen prior to being twisted.
Figure 3:
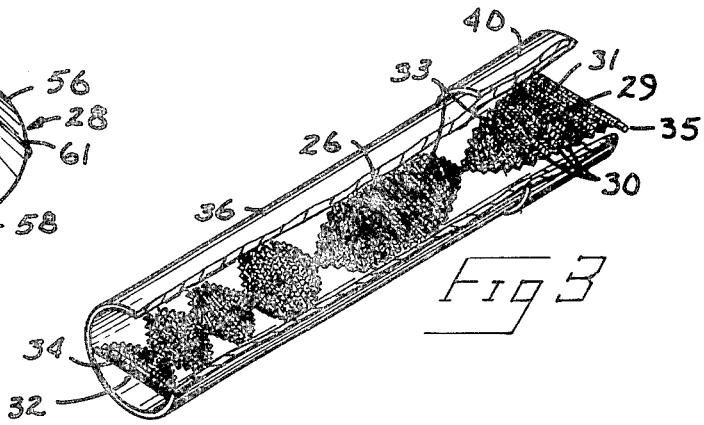
FIG. 3 is an enlarged fragmentary isometric view of the screen.

Screen 26 is shown in substantial detail in FIGS. 1, 2 and 3. As shown, screen 26 is comprised of a ribbon or wire mesh 29. This ribbon includes a width dimension that is approximately equal to the inside diameter of the fuel supply tube 14. The wire mesh 29 is twisted along its length to form the sprial configuration shown in FIGS. 1 and 3. It is preferred, however, that prior to such twisting, the mesh be folded to include a plurality of "accordion" folds 30. These are substantially zigzag type folds across the width of the ribbon (FIG. 2).

The screen 26, after being folded or impressed with the accordion folds 30, is twisted along its length. This is done in such a manner that, at an upstream end 31 there are twists 33 that are relatively gradual and, at a downstream end 32, there are twists 34 of substantially increased pitch. That is to say, the number of twists in the wire mesh ribbon increases toward the downstream end 32. The upstream end 31 is provided with a transverse rod 35 that is affixed to the mesh 29. Rod 35 or an equivalent means prevents escape of the wire mesh from the tube 14 and into the induction tube 11.

As shown in FIG. 1, screen 26 is located within the tube 14 which has a cylindrical metal sleeve 36 inserted therein. It may be noted that the description of the spiral screen 26 has not to this point included the sleeve 36. This has been done because in one form of the invention, the tube 14 and the screen are mounted during the production of the carburetor and the carburetor unit is sold as a whole. It would not then be necessary to produce the screen as a separate item and place it within a metal sleeve 36. However, when the improvement is sold as a modification for existing forms of carburetors, it is preferred that the screen before insertion in the tube 14 be placed within a protective sleeve 36 before it is mounted within the fuel supply tube 14. In this manner, the twists of the screen are protected and insertion of the screen through the length of tube 14 is made substantially easier.

The sleeve 36 is formed of a suitable thin metal (0.002 inches being satisfactory). The sleeve 36 may be formed of a single sheet of thin metal with one side folded over as shown at 40. A tube may then be rolled from the sheet that includes an inside diameter only slightly less (0.004 inches) than the inside diameter of the fuel supply tube 14. The folded end 40 will abut against the inner end of tube 14 to prevent sliding of the sleeve and screen down and outwardly from tube 14.

The air bleed means 27 is shown in FIG. 1. It includes a tube 45 leading into the induction tube 11. This tube 45 is secured through an aperture 46 that is drilled through the carburetor wall and into the tube 11. Tube 45 is rotatably mounted within this aperture 46 to facilitate an air bleed adjustment feature (discussed below). The tube 45 is secured to the carburetor housing by a mounting plate 47 and mounting screws 48.

The air bleed means 27 also includes a second tube 49 that openly communicates with the chamber 18. Tube 49 extends through two holes 50 and 51 formed through the carburetor housing that open into the air vent 19 and chamber 18. When the present improvements are manufactured with the carburetor, these holes will be produced at the manufacturing plant. However, when the improvement is provided in kit form, the holes will be drilled manually by the installer.

A flexible hose 52 interconnects the tubes 45 and 49. This hose is flexible to facilitate installation in various forms of carburetors. Hose 52 is clamped by clamps 54 to outward exposed ends of the tubes 45, 49.

The inward exposed end of tube 45 includes an inclined opening 53. The angle of opening 53 permits adjustment of the amount of air fed through air bleed means 27. This is done by rotating the tube about its axis so that angular opening will face into or away from the air passing through the induction tube 11. Obviously, if the angular opening is facing the incoming air, more air will be supplied through the bleed means 27 to the chamber 18 and, subsequently, a leaner mixture will result. Likewise, if the opening faces downstream, substantially less air will be supplied through means 27 to disperse the gas particles and the result will be a richer mixture.

Figure 4:
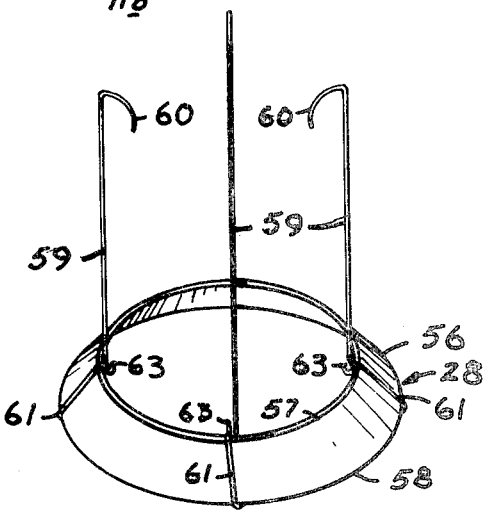
FIG. 4 is an isometric view of a baffle.

The baffle means 28 is illustrated in FIGS. 1 and 4. The baffle means 28 is simply comprised of a tapered ring 56 that is mounted to the venturi 12. The ring 56 is located slightly downstream of the venturi and is suspended by wire clips 59. It includes a reduced inside circular edge 57 that is of a diameter substantially equal to the discharge diameter of the venturi 12. The walls of ring 56 flare outwardly to an enlarged outer edge 58 located adjacent the walls of the induction tube 11. The result is a restriction of flow through the induction tube and corresponding encouragement of air flow through the venturi 12.

An axial space 70 between the tapered ring 56 and the discharge end of the venturi 12 (FIG. 1) creates turbulence within the induction tube downstream of the venturi for further mixing of fuel and air. Air passing downwardly and through the space 70 between venturi 12 and the edge 57 will take on a substantial radial directional component and so will impinge upon the axially moving air exiting from the venturi. This results in turbulence whereby the air and fuel are further mixed to produce a homogeneous fuel-air charge.

The wire clips 59 may be selected according to the physical characteristics of the venturi 12. Preferably, the wire clips extend along over the exterior surface of the venturi so as not to interfere with the smooth guiding interior surfaces. Hooks 60 are provided at the upper end of clips 59 to engage the mouth of the venturi and support the ring against downward axial movement. The clips 59 also include loops 61 at the bottom thereof formed by wrapping the lower portions of the clips about the ring so they extend slightly downward, inward and upward at the ends 63 to engage the venturi at its bottom inside edge. In doing so, the clips 59 prevent axial movement of the ring in both upward and downward directions when the clip hooks 60 are bent inward over the top of the venturi.

If the carburetor is manufactured with the present improvements as integral portions therewith, it is conceivable that there would be no substantial need for the sleeve 36 or flexible connector hose 52. Instead, the spiral screen 26 could be provided as an integral portion of the fuel supply tube 14 during the manufacturing process. Similarly, the air bleed means 27 could be formed by other appropriate apparatus for opening an air bleed path between the induction tube and the chamber 18.

In modifying a conventional carburetor with the present improvement, the carburetor housing must first be disassembled to expose the chamber 18 and to allow access through the open inside end of the fuel supply tube 14. The spiral screen 26 (held within the sleeve 36) may then be easily inserted within the bore of the fuel supply tube 14 and the baffle means 28 may be fixed to the venturi 12.

Mounting of baffle means 28 is accomplished by pushing the clips 59 upwardly from the discharge venturi end (bottom end as shown in FIG. 1) until the hooks 60 bend over the leading venturi edge. At the same time, the ends of loops 61 will slide into place at the venturi bottom edge. The baffle means 28 is thereby secured axially within the induction tube. The wire clips 59 also serve to center the tapered ring 56 relative to the venturi 12.

The final assembly step is to drill holes 46, 50 and 51. This is a relatively simple procedure with the carburetor in a disassembled condition. Tubes 45 and 49 are then inserted and connector hose 52 is attached by means of the clamps 54. The hole 51 has the tube 49 secured therein against movement. Separate holes may then be drilled for the screws 48.

While the engine is running, gasoline is drawn up through the siphon tube 17, then through the fuel supply tube 14. With the spiral screen 26 installed, gasoline droplets will be whirled around the spiral curve with some droplets being drawn through the screen and broken up into smaller droplets. I have found that the larger the number of twists in the spiral, the better is the breaking up of gasoline droplets. This results in better mixing of gasoline and air and allows a leaner mixture of gasoline and air to pass to the engine cylinders. The number of twists along the screen may be increased to the point of maximum economy without sacrificing performance. Further improvements may be made possible by installing a larger main gasoline fuel supply tube and accompanying spiral.

In adjusting the carburetor with the present improvements in place, the spiral screen may be twisted one direction or another and lenthened or shortened to control the passage of gasoline droplets and the degree of obstruction of the fuel supply tube. The accordion folds 30 make this possible. Also, the inclined opening 53 of the air bleed means 27 may be adjusted to aerate the mixture, prior to its delivery into the venturi 12.

The function of the baffle means 28 is to create additional air flow through the venturi rather than to the surrounding areas of the induction tube. In doing so, the obstruction presented by the spiral screen is overcome by the greater vacuum produced through higher velocity air passing through the venturi.

It has been briefly discussed with reference to FIGS. 1 and 3 that the spiral twists between the ends 31 and 32 are not uniform and that the pitch of the spiral twists increases toward the downstream end 32. This is done to gradually confront the fuel droplets with a greater surface area of the screen through which the droplets may pass. Furthermore, the spiraling droplets and air passing through the tube 14 increase in velocity as the pitch of the spirals increase. Therefore, the result is that fuel droplets are more effectively broken up into smaller droplets and the mixture within the tube itself is swirled. As it exits, it does so in an ever increasing spiral to spread and become mixed with the air rushing through the venturi 12.

Figure 7:
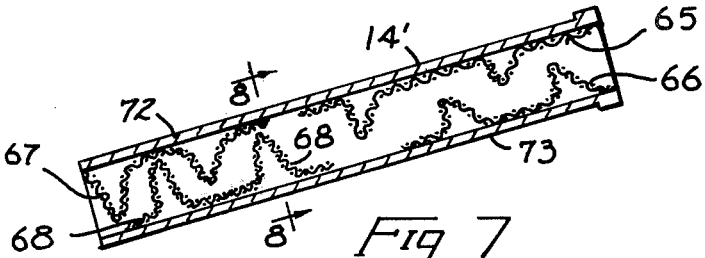
FIGS. 7–11 inclusive show alternate forms of screen in the fuel supply tube of a carburetor.
Figure 8:
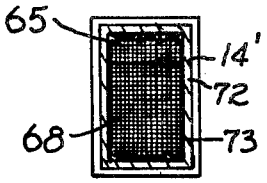
Figure 9:
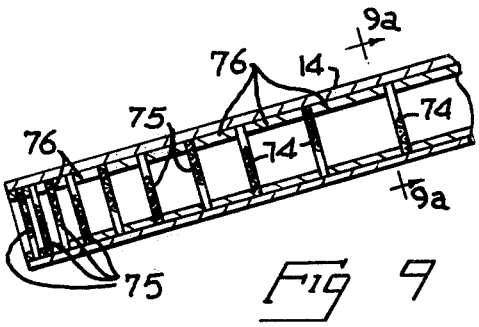
Figure 9A:
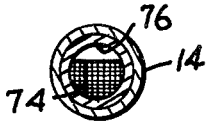
Figure 10:
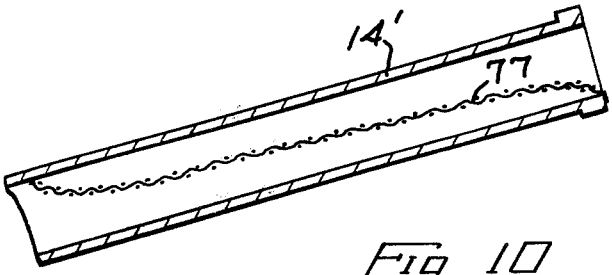
Figure 5:
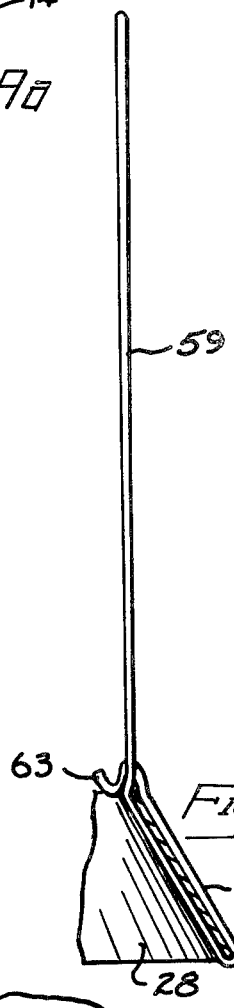
FIG. 5 is a detail view showing the details for mounting a tapered ring from the venturi in the air induction tube of a carburetor.
Figure 11:
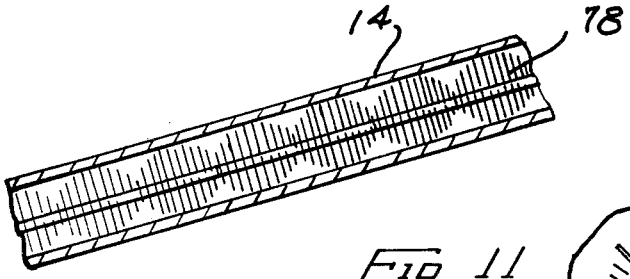
Figure 6:
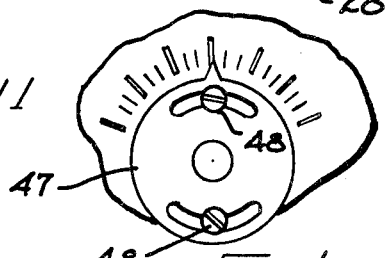
FIG. 6 is a face view of an adjustment means for air-bleed mechanism to the fuel supply tube.

I have found with the use of the present device that the associated engine will produce substantially lower hydrocarbon and carbon monoxide levels in the exhaust and will operate at a considerably lower fuel consumption rate. In addition, other engine functions may be altered due to the improved performance of the carburetor. For example, the choke may open sooner during cold or wet weather conditions since the fuel and air mixture are maintained substantially uniform for combustion. Also because an engine equipped with this gasoline mixing device can be made to idle smoothly at about 500 rpm, the vacuum advance can be connected directly to the intake manifold. This allows the vacuum advance to keep the spark advance during idling and deceleration, thereby lowering hydrocarbon emissions. Likewise, the spark plug gaps may be set substantially wider (for example, 0.060). The screen shown in FIGS. 7 and 8 is made of four pieces of wire mesh. At the upstream end of tube 14' are fastened two pieces 65 and 66 of coarse wire mesh. At the downstream end are fastened two pieces 67 and 68 of finer wire mesh. The fuel supply tube 14' comprising upper half 72 and lower half 73, is rectangular in cross section and the screen pieces 65, 66, 67 and 68 are undulated within the tube 14' so as to cause the fuel to alternately pass through them. In FIG. 9 the screen is made up of a series of coarse, woven screen discs 74 and a second series of finer screen discs 75 which are spaced apart by spacer bands 76 that get narrower toward the discharge end of the cylindrical tube. 14. In FIG. 10 the screen is a plain woven wire screen 77 secured across the upper end of the rectangular tube 14'. In FIG. 11 the screen is a round spiraling brush 78.

The preferred form of screen is the corrugated strip of wire screen twisted as shown in FIGS. 1, 2 and 3. However these other forms shown in FIGS. 7–11 are reasonably effective when secured in the tubes 14' and 14.

It is understood that, from the above description and accompanying drawings, that various alterations may be made therein without departing from the scope of my invention. Therefore, only the following claims are to be taken as strict definitions of my invention.

What I claim is:

1. In a carburetor having an air induction tube, a venturi in the induction tube and a fuel supply tube leading from a first open end within the venturi to a second open end remote from the venturi and in communication with a fuel supply system, a fuel-air mixing improvement comprising:

a wire screen having a width dimension substantially equal to the inside cross-sectional diameter of the fuel supply tube and wherein the screen is received longitudinally within the fuel supply tube to progressively break droplets of fuel into smaller droplets as they are drawn into the airstream passing through the venturi, and to cause turbulence of the droplets as they move through the fuel supply tube; and baffle means within the inducton tube adjacent the venturi for directing flow of air through the venturi.

2. The combination set out by claim 1 wherein the screen is received within a sleeve and wherein the sleeve is received within the fuel supply tube.

3. The combination set out by claim 1 further comprising air bleed means interconnecting the induction tube and fuel supply system to receive and direct air to the fuel entering the fuel supply tube in order to aerate fuel within the fuel supply tube prior to its entry into the induction tube.

4. The combination as set out by claim 1 wherein the screen is folded in an accordion fashion.

5. The combination as set out by claim 1 wherein the screen is twisted and the twist of the screen starts gradually at the second end and increases in pitch toward the first end.

6. The combination as set out by claim 1 wherein the wire screen is comprised of:

a series of woven screen discs of cross-sectional diameters substantially equal to that of the fuel supply tube, and with mesh sizes varying from coarse to fine; and spacer bands adapted to be received within the fuel supply tube for longitudinally spacing the screen discs along the length of the fuel supply tube.

7. The combination as set out by claim 1 wherein the wire screen is comprised of a round spiraling brush adapted to be longitudinally disposed within the fuel supply tube.

8. In a carburetor having an air induction tube, a venturi in the induction tube and a fuel supply tube leading from a first open end within the venturi to a second open end remote from the venturi and in communication with a fuel supply system, a fuel-air mixing improvement comprising:

a wire screen positioned longitudinally within the fuel supply tube to progressively break up fuel droplets into smaller droplets as they are drawn through the fuel supply tube;

said screen having a transverse section extending across the interior of the fuel supply tube at locations along the length of the fuel supply tube; and baffle means within the induction tube adjacent the venturi for directing flow of air through the venturi.

9. The combination set out in claim 8 wherein the screen is received within a sleeve which, in turn, is removably received within the fuel supply tube.

10. The combination set out by claim 8 further comprising adjustable air bleed means operatively connecting the induction tube and the fuel supply for bleeding a selected amount of air through the wire screen within the fuel supply tube.

11. The combination as set out in claim 8 wherein the screen is a mesh screen twisted into a spiral to form said transverse sections and folded in an accordion fashion prior to being twisted into the spiral.

12. The combination as set out by claim 8 wherein the screen includes an upstream and a downstream end and wherein the screen is formed in a spiral, with twist of the screen starting gradually at the second end and increasing in pitch toward the first end.

13. The combination as set out by claim 8 wherein the wire screen is comprised of:

a series of woven screen discs of cross-sectional diameters substantially equal to that of the fuel supply tube, and with mesh sizes varying from coarse to fine; and spacer bands adapted to be received within the fuel supply tube for longitudinally spacing the screen discs along the length of the fuel supply tube.

14. The combination as set out by claim 7 wherein the wire screen is comprised of a round spiraling brush adapted to be longitudinally disposed within the fuel supply tube.

15. The combination as set out by claim 8 wherein the wire screen is comprised of a number of individual pieces of wire mesh with mesh size varying from coarse to fine, said coarse wire mesh pieces being positioned within the fuel supply tube at the second end thereof and said fine wire mesh being positioned within the fuel supply tube at the first end thereof, said screen pieces being undulated so as to cause fuel to alternately pass through the screen undulations.

16. The combination as set out by claim 15 wherein the wire screen is comprised of a number of individual pieces of wire mesh with mesh size varying from coarse to fine, said coarse wire mesh pieces being positioned within the fuel supply tube at the second end thereof and said fine wire mesh being positioned within the fuel supply tube at the first end thereof, said screen pieces being undulated so as to cause fuel to alternately pass through the screen undulations.

* * * * *